US009138079B2

(12) United States Patent
Su

(10) Patent No.: US 9,138,079 B2
(45) Date of Patent: Sep. 22, 2015

(54) DISPLAY FIXTURE

(75) Inventor: Samuel Yuehli Su, Alpine, NJ (US)

(73) Assignee: Toy Wonders, Inc., Moonachie, NJ (US)

( * ) Notice: Subject to any disclaimer, the term of this patent is extended or adjusted under 35 U.S.C. 154(b) by 549 days.

(21) Appl. No.: 13/178,207

(22) Filed: Jul. 7, 2011

(65) Prior Publication Data

US 2013/0008865 A1 Jan. 10, 2013

(51) Int. Cl.

| | |
|---|---|
| ***A47B 43/00*** | (2006.01) |
| ***A47F 5/11*** | (2006.01) |
| ***A47B 87/02*** | (2006.01) |
| *A47B 57/06* | (2006.01) |

(52) U.S. Cl.

CPC ..... *A47F 5/11* (2013.01); *A47B 87/0215* (2013.01); *A47B 57/06* (2013.01)

(58) Field of Classification Search

CPC ..... A47F 5/11; A47B 87/0215; A47B 57/06
USPC ..... 211/126.7, 126.12, 14, 188, 186, 187, 211/189, 190–194, 134; 108/91, 180, 186, 108/189, 190, 157.16, 158.12; 312/108, 312/111, 265.1
See application file for complete search history.

(56) References Cited

U.S. PATENT DOCUMENTS

| | | | | |
|---|---|---|---|---|
| 1,355,486 A | | 10/1920 | Longenecker | |
| 2,235,709 A | * | 3/1941 | Hearn et al. | 206/449 |
| 3,674,229 A | | 7/1972 | Keeler, II | |
| 3,955,863 A | * | 5/1976 | Yellin | 312/265.2 |
| 3,964,810 A | * | 6/1976 | Murphy | 312/265.2 |
| 4,050,386 A | * | 9/1977 | Kellogg | 108/190 |
| 4,158,336 A | | 6/1979 | Brescia et al. | |
| 4,292,901 A | * | 10/1981 | Cox | 108/55.1 |
| 4,493,425 A | * | 1/1985 | Yoshida | 211/189 |
| 4,534,475 A | * | 8/1985 | Mayo | 211/126.12 |
| 4,706,576 A | * | 11/1987 | James | 108/192 |
| 4,757,769 A | * | 7/1988 | Suttles | 108/190 |
| 4,787,553 A | * | 11/1988 | Hoskins | 24/1 |
| 4,884,701 A | * | 12/1989 | Nymark et al. | 211/69.8 |
| 4,930,643 A | * | 6/1990 | Flum | 211/188 |
| 4,998,023 A | * | 3/1991 | Kitts | 280/47.35 |
| 5,158,187 A | | 10/1992 | Taub | |
| 5,433,326 A | * | 7/1995 | Horian | 211/188 |
| 5,628,256 A | * | 5/1997 | Lazarus | 108/110 |
| 5,722,544 A | * | 3/1998 | Williams | 211/188 |

(Continued)

FOREIGN PATENT DOCUMENTS

GB 2232344 A 12/1990

*Primary Examiner* — Joshua J Michener
*Assistant Examiner* — Devin Barnett
(74) *Attorney, Agent, or Firm* — Nelson Mullins Riley & Scarborough, LLP

(57) ABSTRACT

A display fixture is disclosed. In one embodiment, a display fixture comprises a plurality of shelves and a plurality of posts supporting the plurality of shelves. Each shelf may comprise a panel, a plurality of apertures formed in the panel and a plurality of walls extending upwardly from the panel and forming a perimeter of the panel. Each post may comprise a shoulder, a columnar member extending from the shoulder, a seat disposed opposite the shoulder and comprising a cavity configured to receive a columnar member from another post, an elongate body disposed between and joining the shoulder and the seat, and a skirt extending from the body and surrounding the seat. The skirt and the seat may define a tapered recess, which may expand to receive a portion of the panel walls.

19 Claims, 15 Drawing Sheets

(56) References Cited

U.S. PATENT DOCUMENTS

| | | | | | |
|---|---|---|---|---|---|
| 5,918,551 | A | * | 7/1999 | Liu | 108/55.1 |
| 5,918,751 | A | * | 7/1999 | Kelly | 211/194 |
| 5,934,486 | A | * | 8/1999 | Jarvis et al. | 211/41.8 |
| 5,996,510 | A | * | 12/1999 | Harpman et al. | 108/51.3 |
| 6,062,150 | A | * | 5/2000 | Sikora et al. | 108/190 |
| 6,079,339 | A | | 6/2000 | Houk, Jr. et al. | |
| 6,148,736 | A | * | 11/2000 | Erbs | 108/27 |
| 6,178,896 | B1 | | 1/2001 | Houk, Jr. et al. | |
| 6,364,133 | B1 | * | 4/2002 | Sheng | 211/46 |
| 7,066,342 | B2 | * | 6/2006 | Baechle et al. | 211/191 |
| 7,137,517 | B2 | * | 11/2006 | Lowry et al. | 211/188 |
| D609,503 | S | * | 2/2010 | Hayes | D6/480 |
| D615,777 | S | * | 5/2010 | Lee et al. | D6/479 |
| 8,317,039 | B2 | * | 11/2012 | Norman | 211/60.1 |
| 2003/0173321 | A1 | | 9/2003 | Craft et al. | |
| 2006/0151410 | A1 | * | 7/2006 | Lowry et al. | 211/126.16 |

* cited by examiner

DISPLAY FIXTURE

RELATED APPLICATION

The present application is related to commonly-owned U.S. Design patent application No. 29/396,836, entitled "Display Fixture," which is filed concurrently herewith and which is incorporated by reference herein in its entirety for all purposes.

FIELD OF THE INVENTION

The present invention relates generally to a display fixture. More particularly, the present invention relates to a display fixture with removable and stackable posts.

BACKGROUND

Merchandise is often displayed in retail settings on racks, fixtures, or shelving units. Some display fixtures are of a predetermined configuration and of fixed height between shelf levels. However, the size and quantity of merchandise to be displayed varies. Fixed systems obviously cannot accommodate these changes, requiring merchants to purchase additional and different types of display fixtures for use with different or changing merchandise. Other display fixtures require the use of fasteners for assembly. Assembly and disassembly of such systems requires the use of tools, increases the complexity of assembly and disassembly, and increases the possibility of misplaced or lost fasteners when moving or storing these display fixtures. Still other display fixtures utilize corner posts that secure directly into the shelves above and below, which may transfer more loads than desired into the shelves.

SUMMARY

The present invention recognizes and addresses disadvantages of prior art constructions and methods. Embodiments of the present invention provide a display fixture. In one aspect, the present invention provides a display fixture comprising a plurality of shelves and a plurality of posts supporting the plurality of shelves. Each shelf may comprise a panel, a plurality of apertures formed in the panel and a plurality of walls extending upwardly from the panel and forming a perimeter of the panel. Each post may comprise a shoulder, a columnar member extending from the shoulder, a seat disposed opposite the shoulder and comprising a cavity configured to receive a columnar member from another post, an elongate body disposed between and joining the shoulder and the seat, and a skirt extending from the body and surrounding the seat. The skirt and the seat may define a tapered recess. The tapered recess may expand to receive a portion of the panel walls.

In another aspect, the present invention provides a post for a shelf comprising a panel wall in which the post comprises a body comprising a first end and a second end opposite the first end. A shoulder may be disposed on the first end of the body and a seat disposed on the second end of the body. A columnar member may extend from the shoulder. In one embodiment, the seat may comprise a cavity that may be configured to receive a columnar member from a second post. Likewise, the columnar member is configured to be received by the second post. The post may comprise means for retaining the panel wall. In one embodiment, the retaining means may comprise a plurality of ribs extending from the body. In another embodiment, the retaining means may comprise a skirt extending from the body. The skirt may surround the seat. The skirt and the seat may define a tapered recess, which may be configured to receive a corner of the shelf.

In an embodiment where the corner of the shelf is not retained by the tapered recess, the skirt is not parallel with a wall of the seat. In an embodiment where the corner of the shelf is retained by the tapered recess, the skirt is parallel to the wall of the seat. The tapered recess expands to receive the corner of the shelf, and thus, is no longer tapered. The skirt may comprise a lip projecting obliquely from a base of the skirt.

In still another aspect, the present invention provides an interlocking post assembly comprising at least two posts. Each of the two posts may comprise a shoulder, a seat disposed opposite the shoulder, an elongate body disposed between and joining the shoulder and the seat, and a skirt extending from the body and surrounding the seat. The shoulder may comprise a columnar member. The seat may comprise a cavity. The skirt may comprise a lip projecting obliquely from a base of the skirt. The skirt and the seat may define a tapered recess.

In one embodiment, the columnar member of a first post is slidably received by the cavity of a second post. The shoulder of the first post and the seat of the second post may be disposed in abutting engagement. The skirt of the second post may be disposed in gripping engagement with the first post. The tapered recess of the second post expands to receive a portion of the body of the first post. The engagement of the first post against the lip of the skirt of the second post urges the skirt of the second post from the seat of the second post.

Those skilled in the art will appreciate the scope of the present invention and realize additional aspects thereof after reading the following detailed description of the preferred embodiments in association with the accompanying drawing figures.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
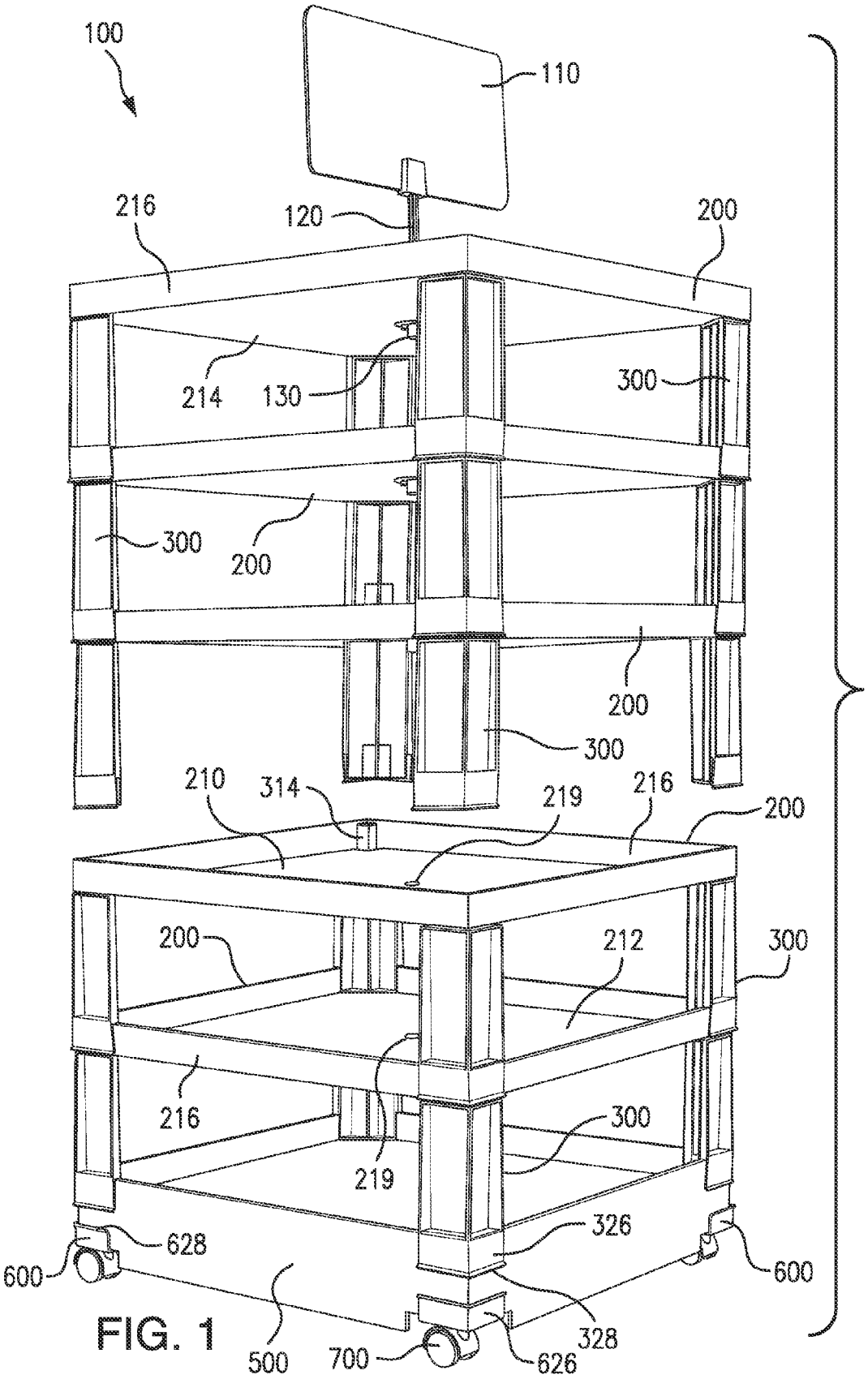
FIG. 1 shows a perspective view of a display fixture according to an embodiment of the present invention having a plurality of shelves.
Figure 2:
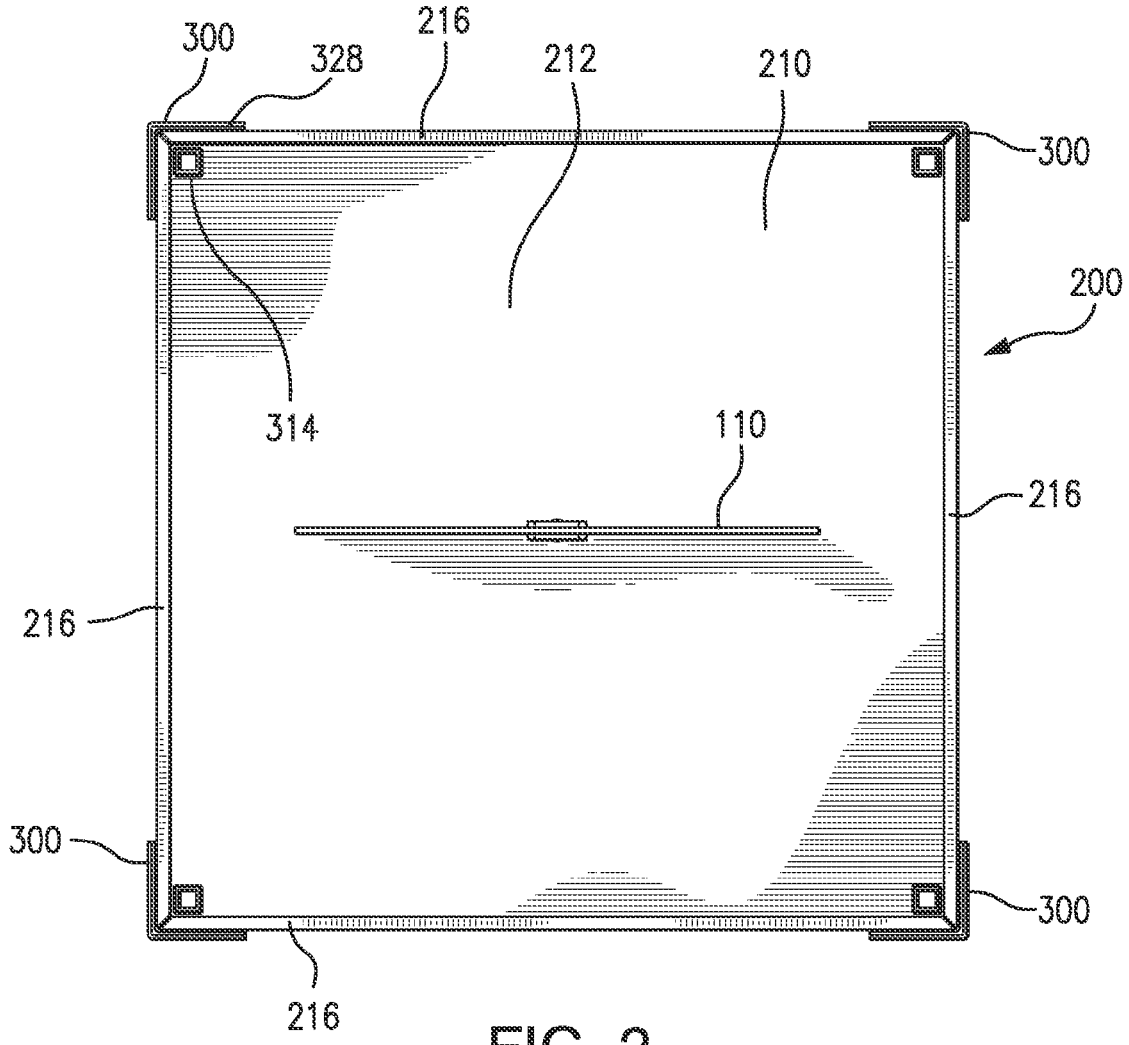
FIG. 2 shows a top plan view of the uppermost shelf of the display fixture of FIG. 1.

Repeat use of reference characters in the present specification and drawings is intended to represent same or analogous figures or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring now to FIGS. 1-6, an exemplary embodiment of a display fixture 100 is shown. The display fixture 100 may be used to display or store toys or other items. The display fixture 100 can be adapted readily to accommodate various configurations. For example, a plurality of shelves 200 can be added or removed without the use of fasteners. Additionally, as posts 300 can be stacked one atop another, a height between shelves 200 can be altered permitting larger items to be displayed or stored. As the display fixture 100 requires no fasteners, assembly and disassembly of the display fixture 100 is relatively simple.

The display fixture 100 includes a plurality of shelves 200, which are supported by a plurality of posts 300 disposed between the shelves 200. A base 500 is the bottommost shelf and supports the plurality of shelves 200 and the plurality of posts 300. The base 500 is supported by a plurality of base supports 600, which include caster wheels 700 to facilitate movement of the display fixture 100.

The display fixture 100 shown in FIG. 1 is partially disassembled to facilitate its description herein. The number of shelves 200 can be varied from that shown and described herein. The shelves 200 shown are square in shape. However, other suitable or desired shapes can be used for the shelves 200. The posts 300 can be modified accordingly to accommodate the particular shape of the shelves 200. However, the posts 300 will be described herein with reference to supporting the plurality of square shelves 200 shown herein.

Figure 3:
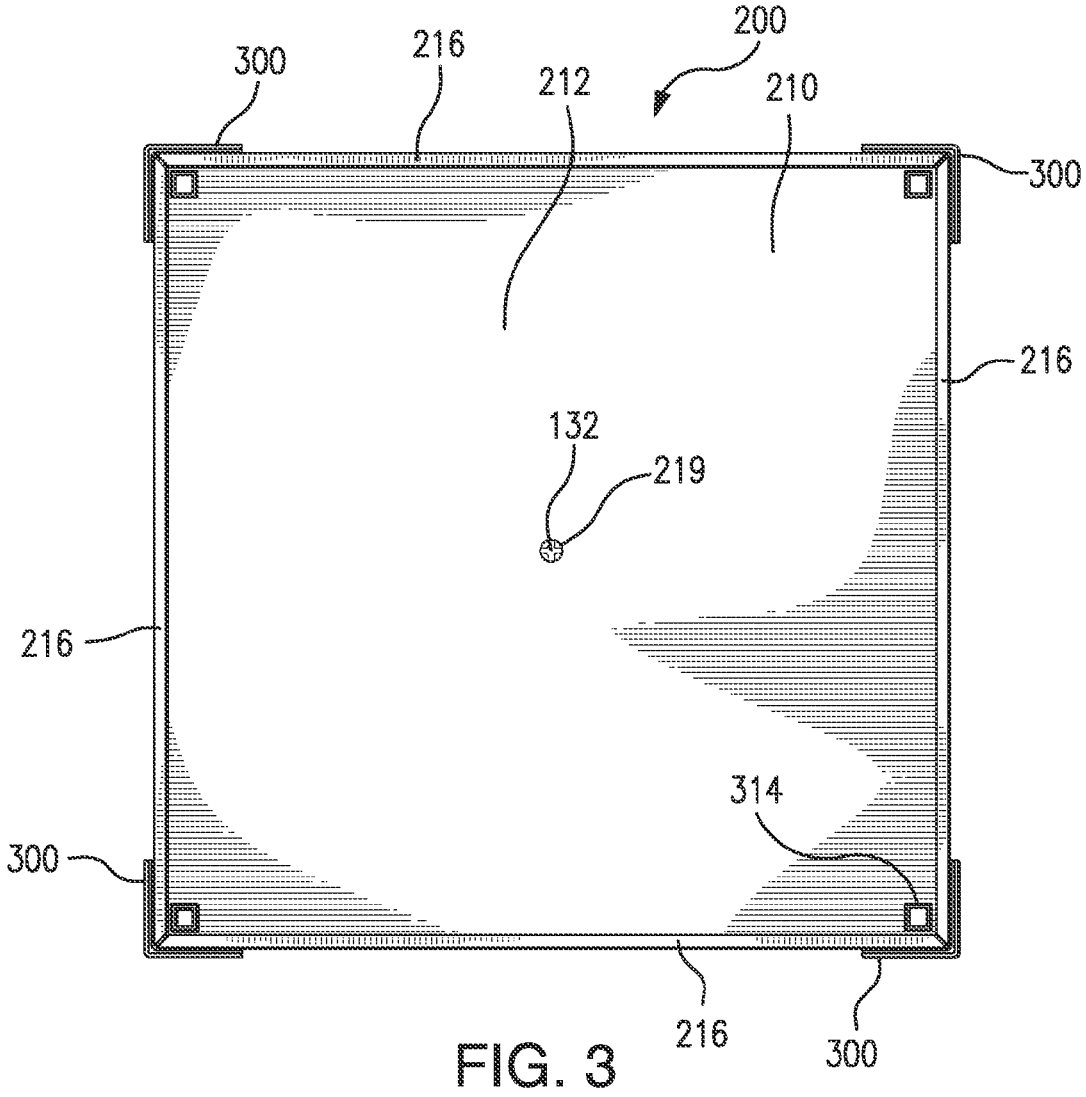
FIG. 3 shows a top plan view of the uppermost shelf of the display fixture of FIG. 1 with a placard removed.
Figure 4:
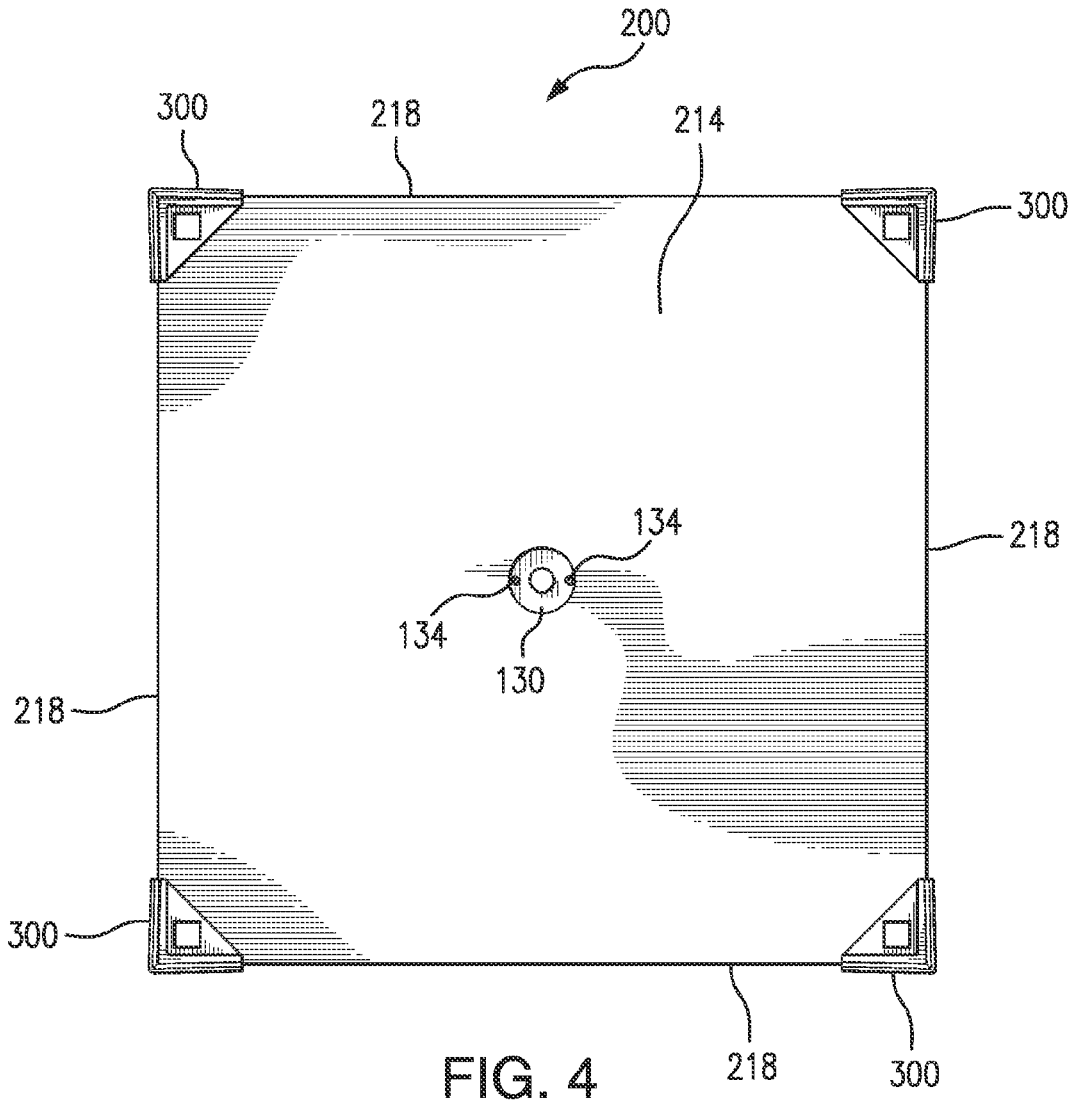
FIG. 4 shows a bottom plan view of the uppermost shelf of the display fixture of FIG. 1.
Figure 5:
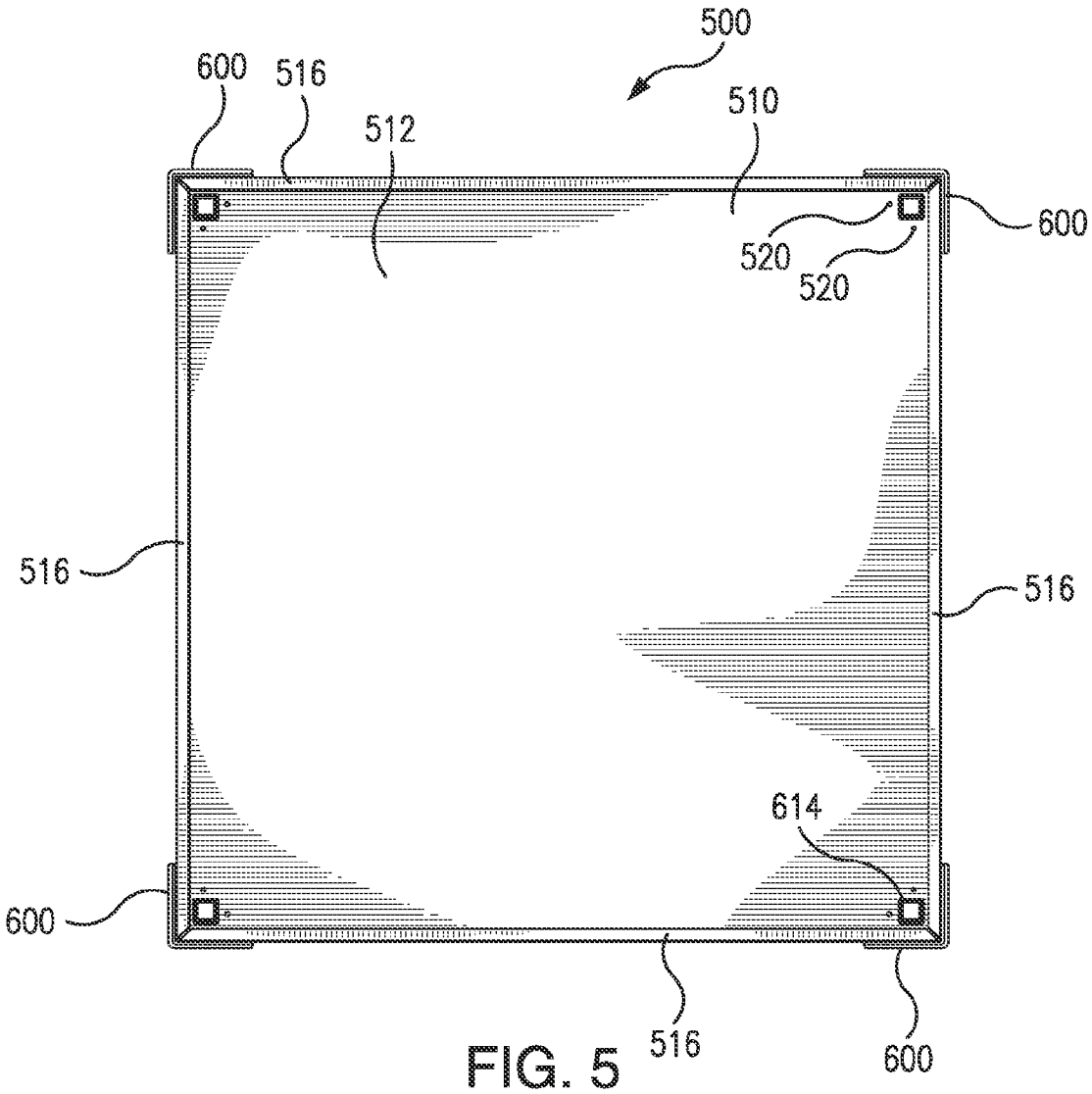
FIG. 5 shows a top plan view of the base of the display fixture of FIG. 1.
Figure 6:
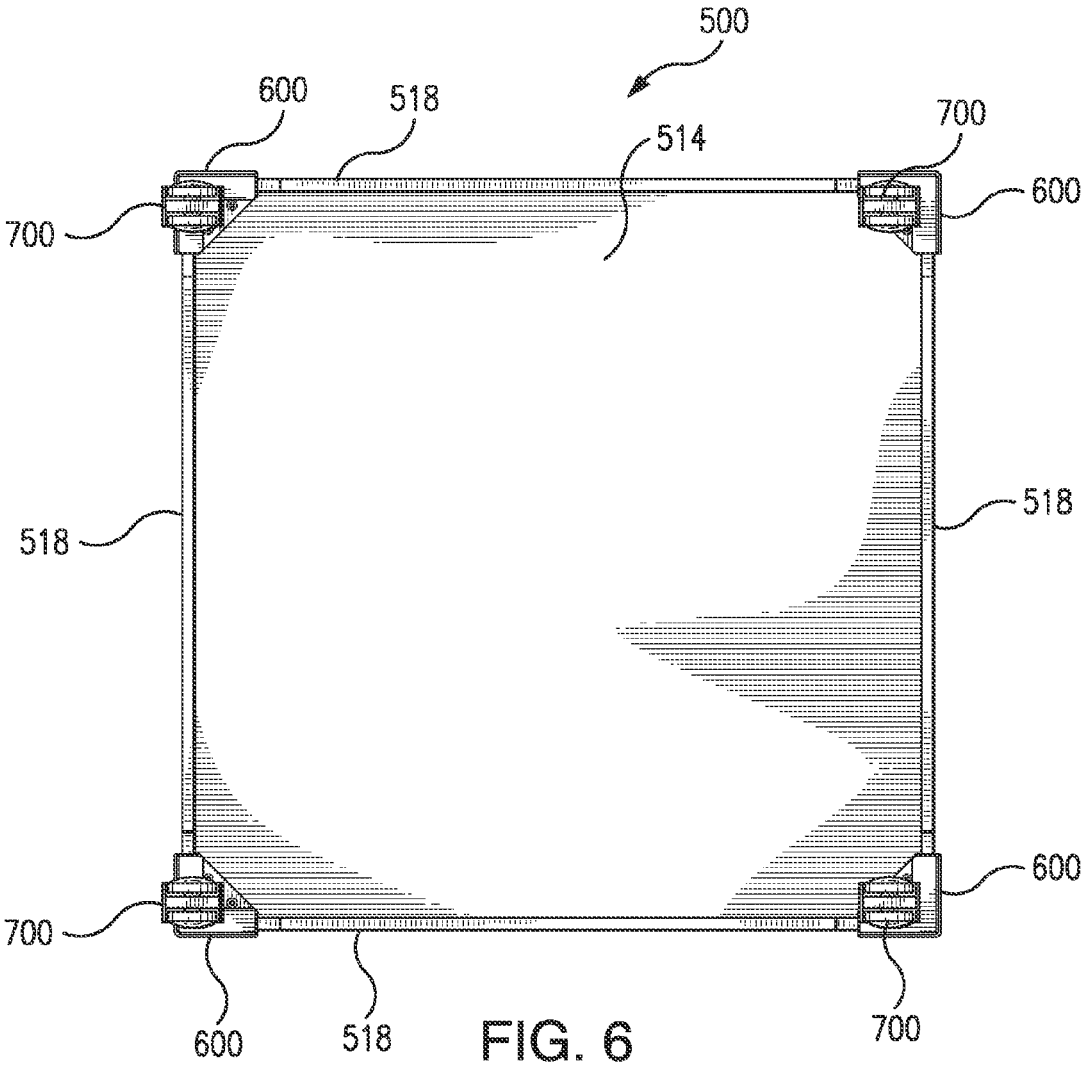
FIG. 6 shows a bottom plan view of the base of the display fixture of FIG. 1.
Figure 7:
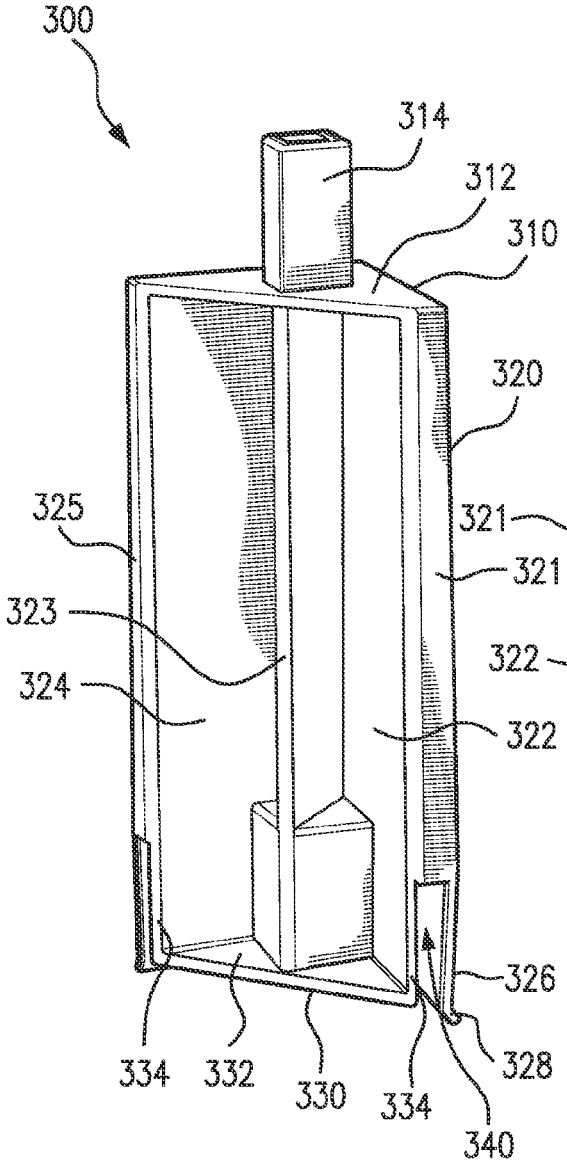
FIG. 7 shows a rear perspective view of one of the plurality of the posts of the display fixture of FIG. 1.
Figure 8:
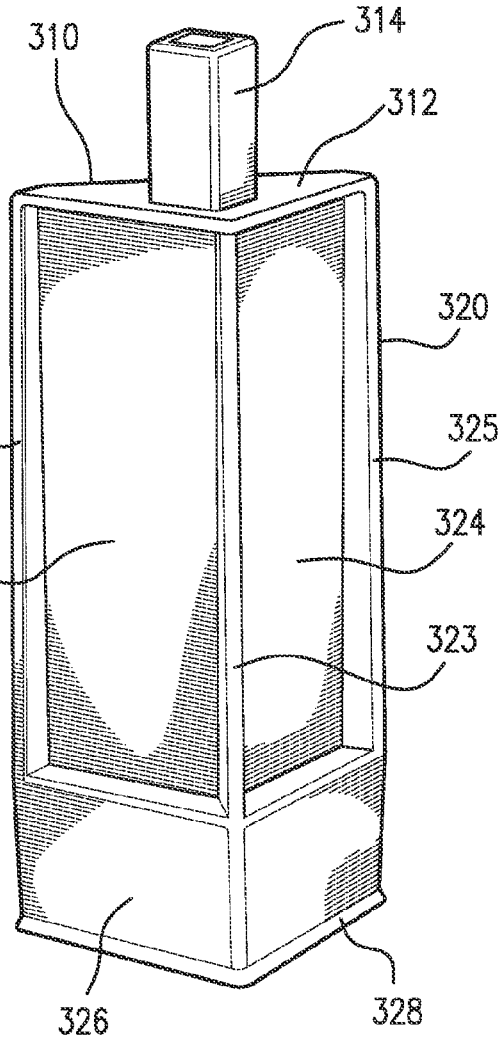
FIG. 8 shows a front perspective view of the post of FIG. 7.
Figure 9:
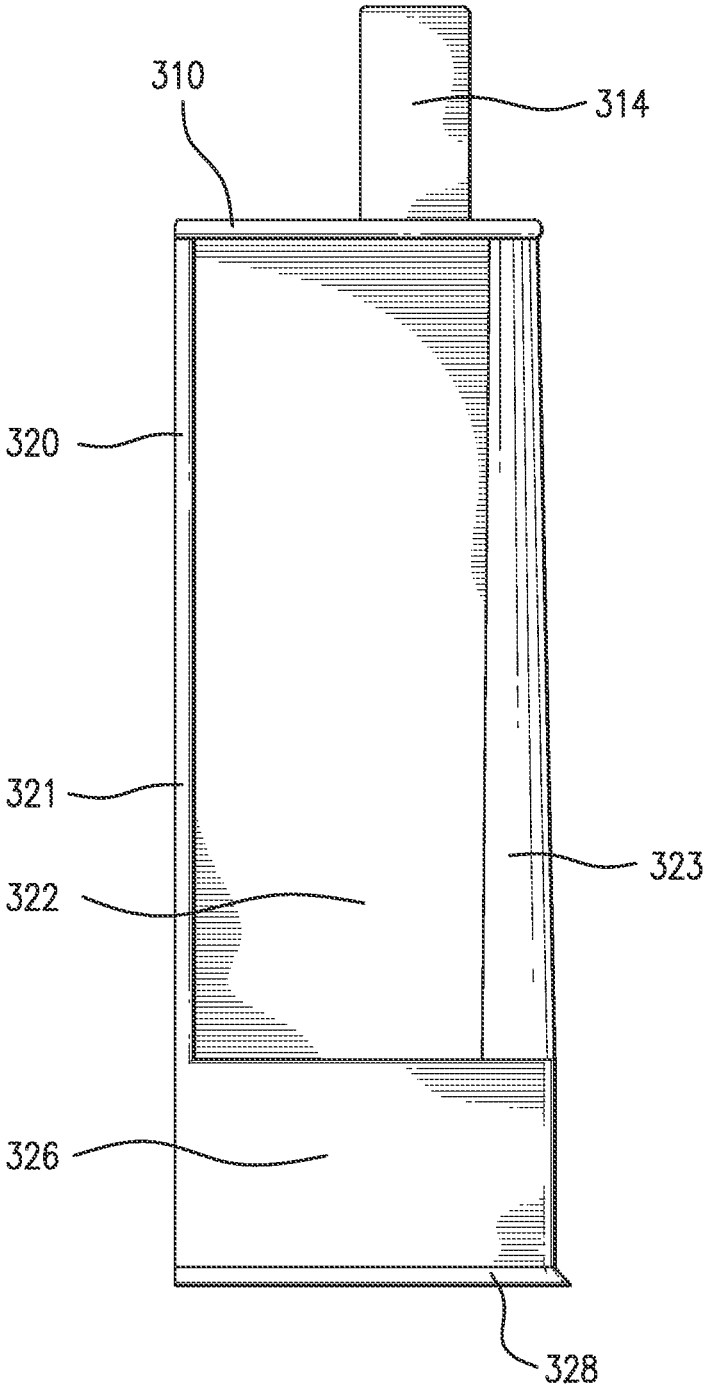
FIG. 9 shows a side elevation view of the post of FIG. 7.
Figure 10:
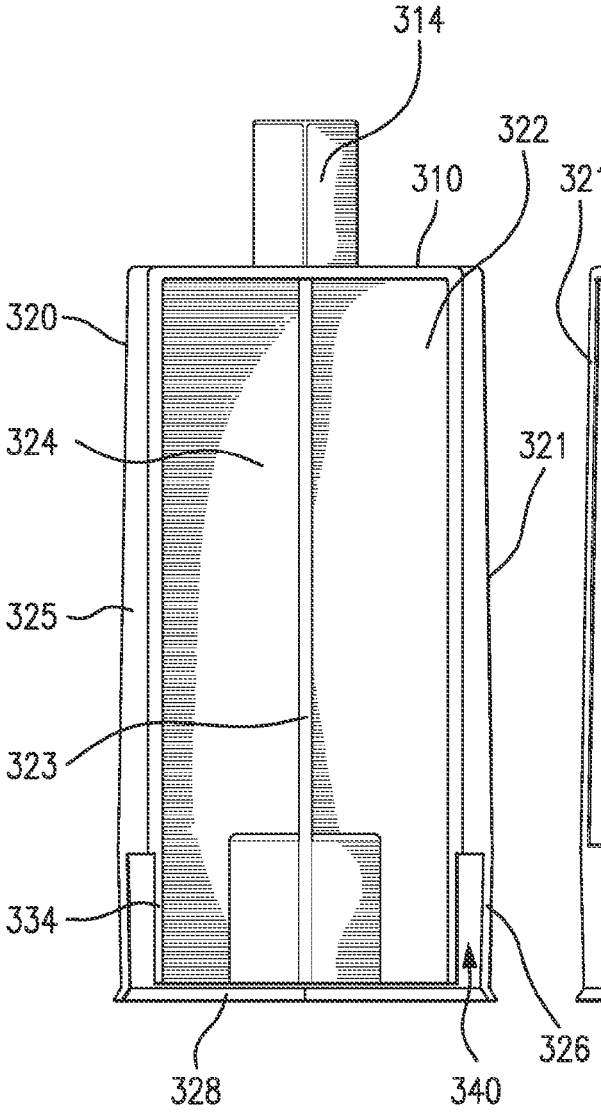
FIG. 10 shows a rear elevation view of the post of FIG. 7.
Figure 11:
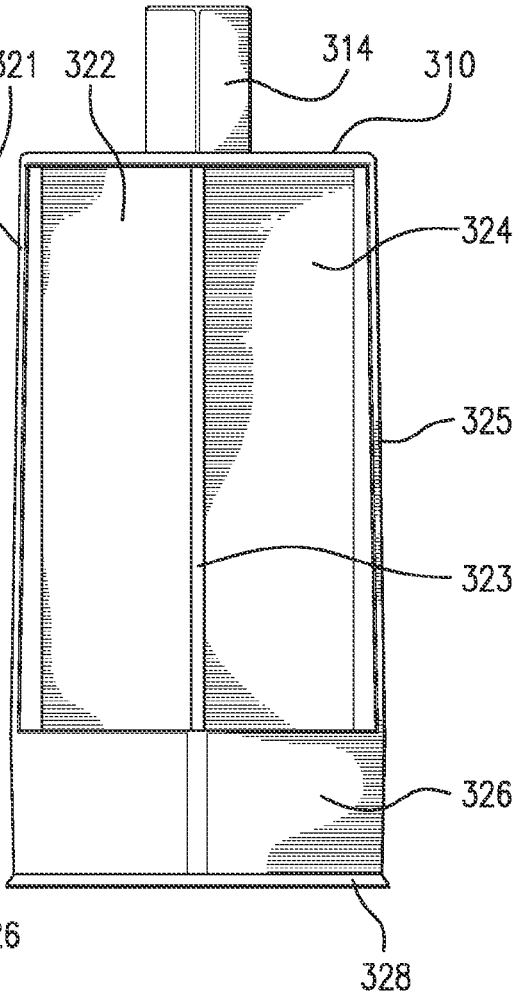
FIG. 11 shows a front elevation view of the post of FIG. 7.
Figure 12:
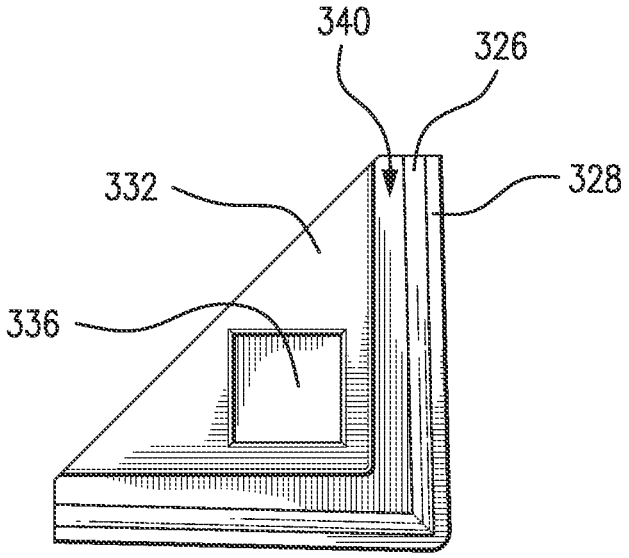
FIG. 12 shows a bottom plan view of the post of FIG. 7.
Figure 13:
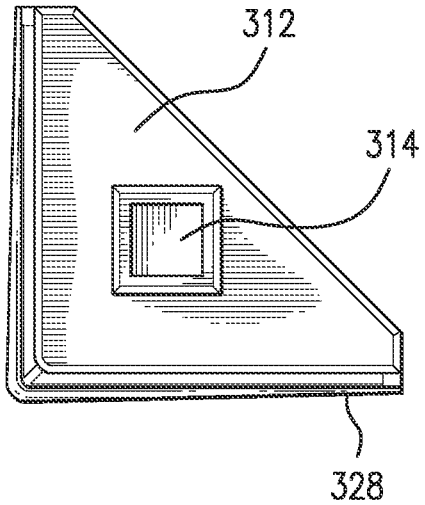
FIG. 13 shows a top plan view of the post of FIG. 7.

The display fixture 100 may include a placard 110 supported by a rod 120. The placard 110 may include text or images to advertise or promote the merchandise placed on the display fixture 100. As shown in FIG. 3, the placard 110 and rod 120 may be removed from the display fixture 100.

Each shelf 200 may include a substantially planar panel 210 formed of cardboard. Other suitable materials can be used for the panel 210, such as for example, paperboard, corrugated fiberboard, boxboard, cartonboard, containerboard, binder board, or plastics. The panel 210 may include a top surface 212 and a bottom surface 214. The top surface 212 may be formed of a separate component and joined or attached with the bottom surface 214 to form the panel 210. Alternatively, the top surface 212 may be formed integrally with the bottom surface 214. The bottom surface 214 supports the top surface 212. Outer portions of the bottom surface 214 may fold over to form a plurality of panel walls 216 defining a perimeter 218 of the panel 210. The walls 216 extend upwardly from the bottom surface 214 of the panel 210.

A plurality of apertures (not shown) are formed in the panel 210 to facilitate engagement with the plurality of posts 300 as will be described in further detail below. An orifice 219 is formed in the panel 210 to enable the rod 120 to be inserted into and supported by a rod support 130. The orifice 219 and the rod support 130 can be disposed in the center of the panel 210, or elsewhere depending on the desired position of the placard 110. The rod support 130 can be secured to the panel 210 by one or more fasteners 134. The rod support 130 may include a guide 132 to facilitate the placement and engagement of the rod 120 in the rod support 130. As shown, the guide 132 may be cross-shaped, which forms a complementary or mating shape with the rod 120. Other suitable shapes or configurations may be used for the rod 120 and the guide 132.

The display fixture 100 includes a base 500, which supports the display fixture 100. The base 500 also may be used to display merchandise (not shown) as do the plurality of shelves 200. The base 500 shown is square in shape and generally corresponds in shape and configuration with that of the plurality of shelves 200. Other suitable or desired shapes can be used for the base 500.

The base 500 may include a substantially planar base panel 510 formed of cardboard. Other suitable materials can be used for the base panel 510, such as for example, paperboard, corrugated fiberboard, boxboard, cartonboard, containerboard, binder board, or plastics. The base panel 510 may include a top surface 512 and a bottom surface 514. The top surface 512 may be formed of a separate component and joined or attached with the bottom surface 514 to form the base panel 510. Alternatively, the top surface 512 may be formed integrally with the bottom surface 514. The bottom surface 514 supports the top surface 512. A plurality of base panel walls 516 extend upwardly beyond the top surface 512 and downwardly below the bottom surface 514 and define a perimeter 518 of the base panel 510. A plurality of fasteners 520 couples the plurality of base support posts 600 to the base 500.

Referring now to FIGS. 7-13, an exemplary embodiment of the post 300 is shown. The plurality of posts 300 supports the plurality of shelves 200. Each post 300 includes a first end 310 and a second end 330 disposed opposite the first end 310. The first end 310 can include a shoulder 312, which can be a substantially planar surface to facilitate engagement of the post 300 with the bottom surface 214 of the panel 210.

Extending from the shoulder 312 of the first end 310 is a columnar member 314. The columnar member 314 may be rectangular and its cross-section taken along an axis orthogonal to the longitudinal axis of the post 300 can be square. Other suitable cross-sections can be used, such as for example, round or triangular. The columnar member 314 is hollow, although it can also be solid in an alternate embodiment.

The second end 330 can include a seat 332, which can be a substantially planar surface to facilitate engagement of the post 300 with the top surface 212 of the panel 210. The seat 332 can include a seat wall 334, which is disposed substantially orthogonal to the seat 332 and along a perimeter of the seat 332. A cavity 336 is formed in the seat 332. The cavity 336 is configured to slidably receive the columnar member 314 from another post 300. Likewise, the columnar member 314 is configured to be received by another post 300.

Disposed between and joining the shoulder 312 of the first end 310 and the seat 332 of the second end 330 is an elongate body 320. The elongate body 320 includes planar surfaces 322, 324. On an outer surface (see FIG. 8), the planar surfaces 322, 324 are sunken and framed by ribs 321, 323, 325. Alternatively, the elongate body 320 can be solid. On an inner surface (see FIG. 7), the planar surfaces 322, 324 are bisected by rib 323 and extend from the shoulder 312 of the first end 310 to the seat 332 of the second end 330.

Extending from the elongate body 320 is a skirt 326 surrounding the seat 332 and the seat wall 334. A lip 328 is formed integrally with a base of the skirt 326 and projects obliquely from the skirt 326. As better seen in FIG. 7, the skirt 326 and the seat 332 define a tapered recess 340, that is, the skirt 326 is not parallel to the seat wall 334. At a distal position from the seat 332, the tapered recess 340 is dimensioned to correspond substantially to a thickness of the panel walls 216. Proximal to the seat 332, the tapered recess 340 is dimensioned to be less than the thickness of the panel wall 216. The tapered recess 340 of each post 300 is thus configured to receive the corner of the panel walls 216 of each shelf 200.

The tapered recess 340 of each post 300 expands to receive a portion of the panel walls 216. As better seen in FIG. 1, the corners of the panel walls 216 are received by the tapered recess 340. The post 300 is in gripping engagement with a perimeter surface of the corners of the panel walls 216. When the corner of the shelf 200 is received in the tapered recess 340, the skirt 326 is parallel to the seat wall 334. Thus, in this configuration, the tapered recess 340 is no longer tapered. When the corners of the panel walls 216 are removed from the tapered recess 340, the skirt 326 returns substantially to its original position. Thus, this configuration of the post 300, including the skirt 326, the elasticity of the skirt 326, and the seat wall 334 comprise the means for retaining a corner of the shelf 200.

Figure 14:
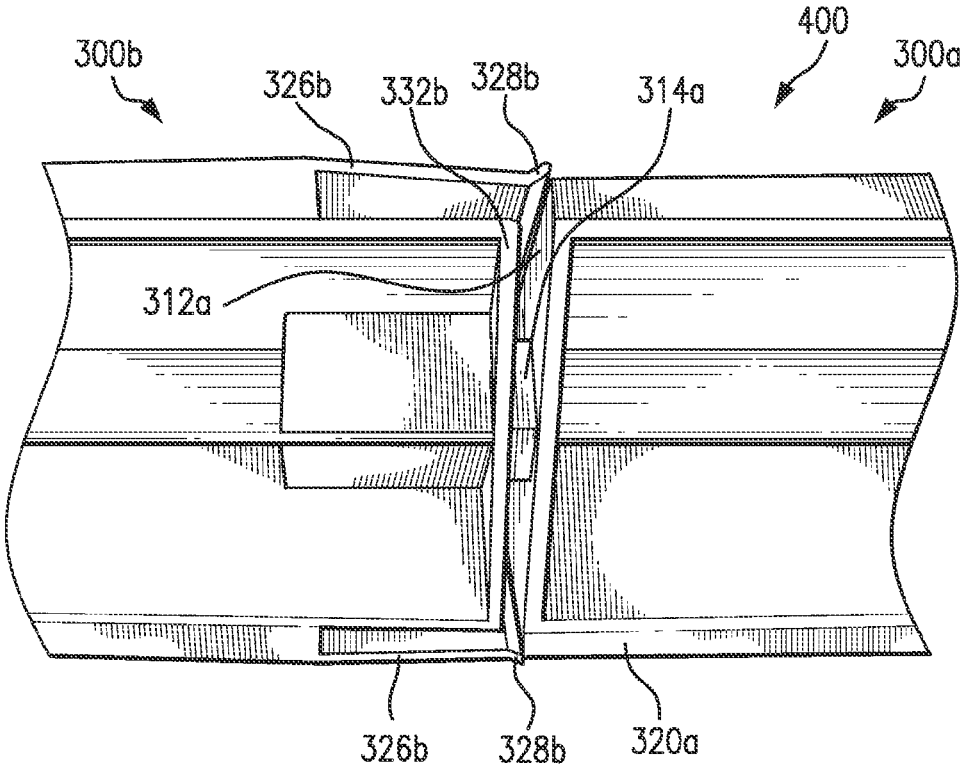
FIG. 14 shows a perspective view of two posts according to an embodiment of the present invention.

When a first shelf 200 is joined or coupled with a second shelf 200, the columnar member 314 of a first post 300 extends through one of the apertures of one of the panels 210 and is slidably received by the cavity 336 of a second post 300. The panel 210 is interposed between the shoulder 312 of the first post 300 and the seat 332 of the second post 300. In another embodiment, a third post 300 can be coupled directly with the second post 300 (that is, without an intervening panel 210). Two posts 300 interlocked together will be described below and with reference to FIGS. 14 and 15.

Figure 15:
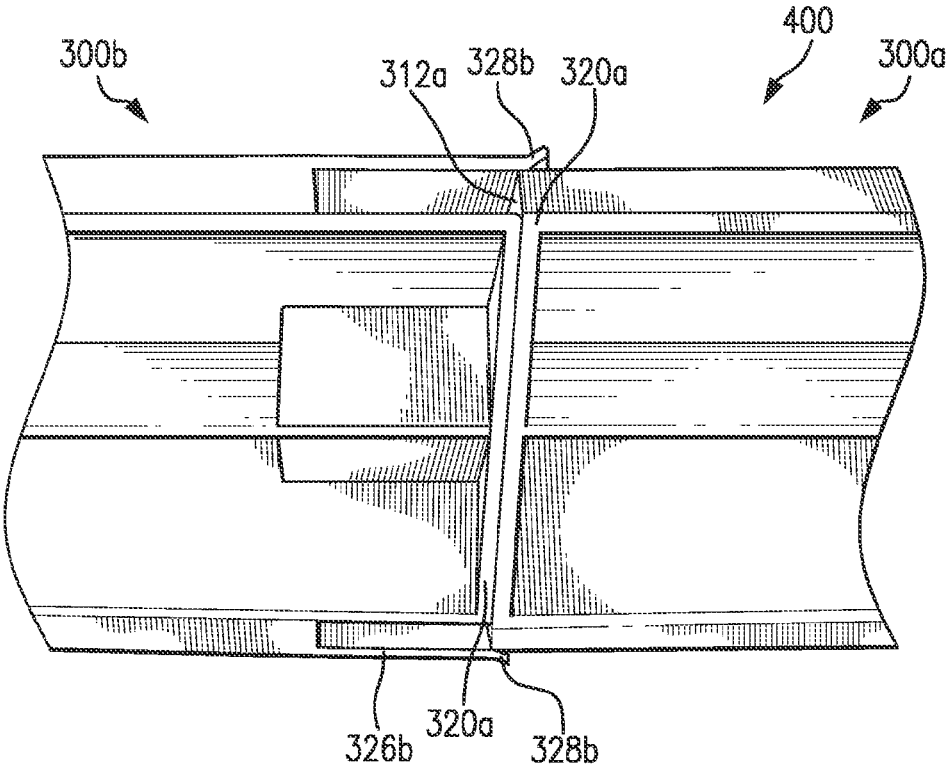
FIG. 15 shows a perspective view of the two posts of FIG. 14 in an interlocked configuration.
Figure 16:
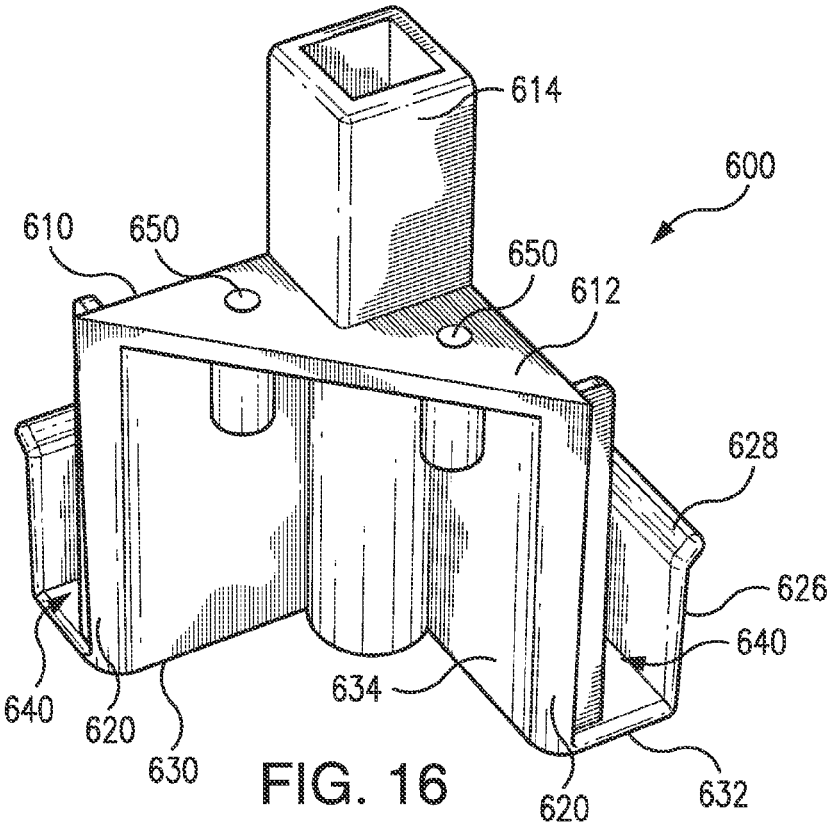
FIG. 16 shows a rear perspective view of a base support post without caster wheel of the display fixture of FIG. 1.
Figure 17:
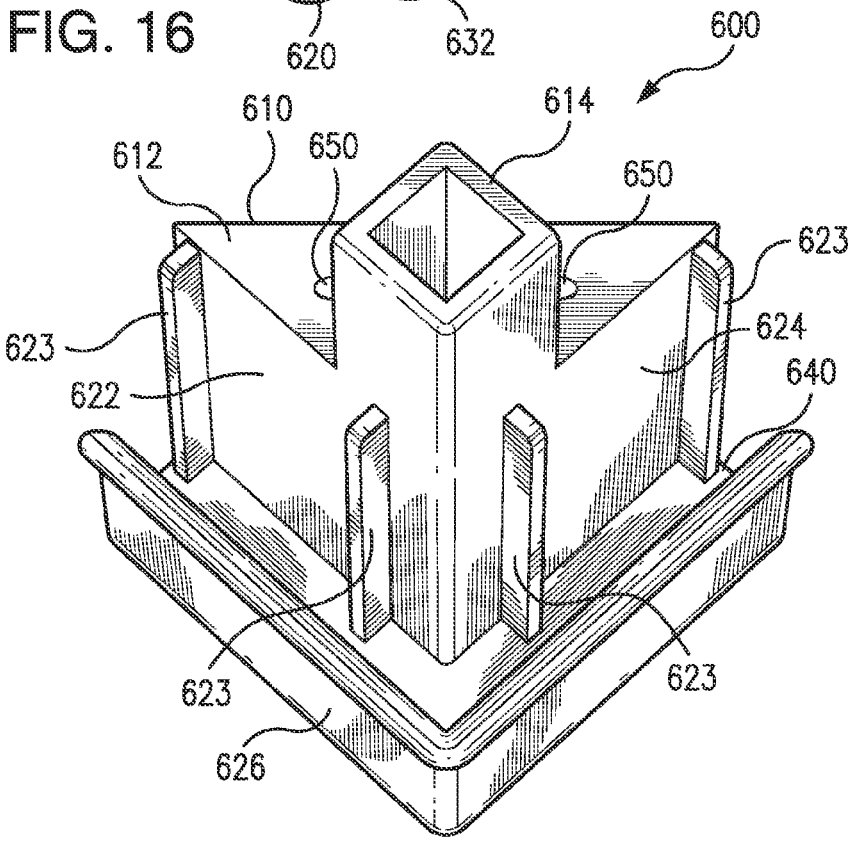
FIG. 17 shows a front perspective view of the base support post of FIG. 16.
Figure 18:
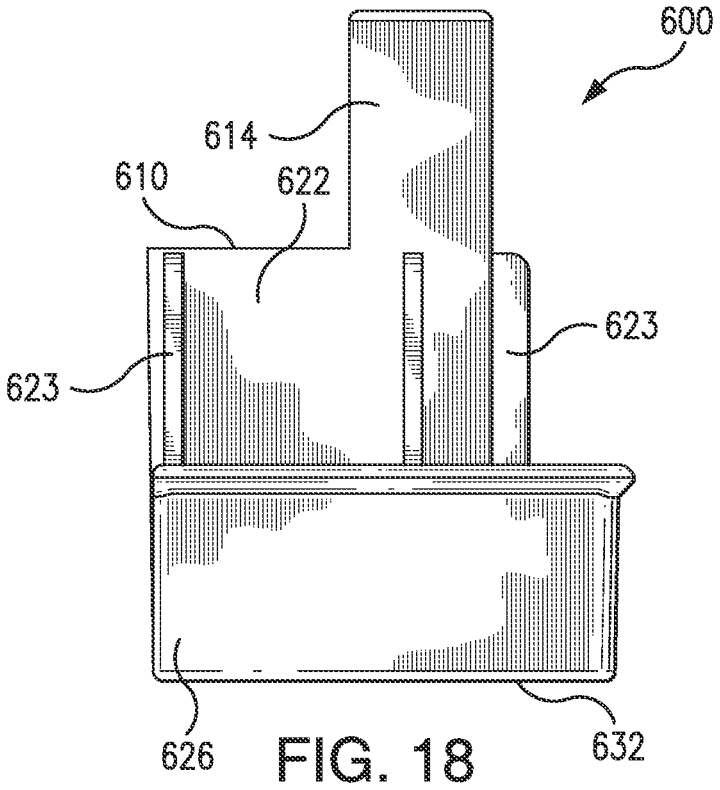
FIG. 18 shows a side elevation view of the base support post of FIG. 16.
Figure 19:
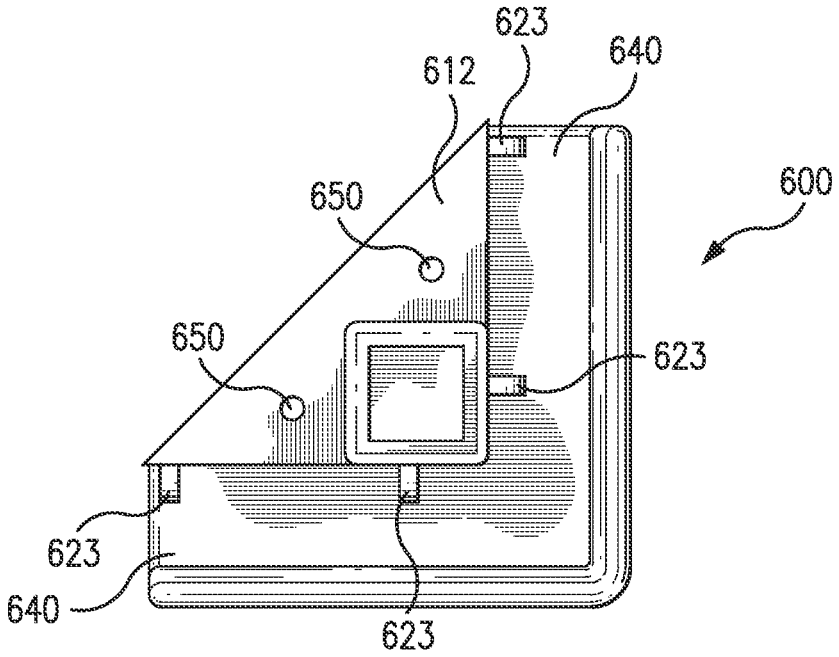
FIG. 19 shows a top plan view of the base support post of FIG. 16.
Figure 20:
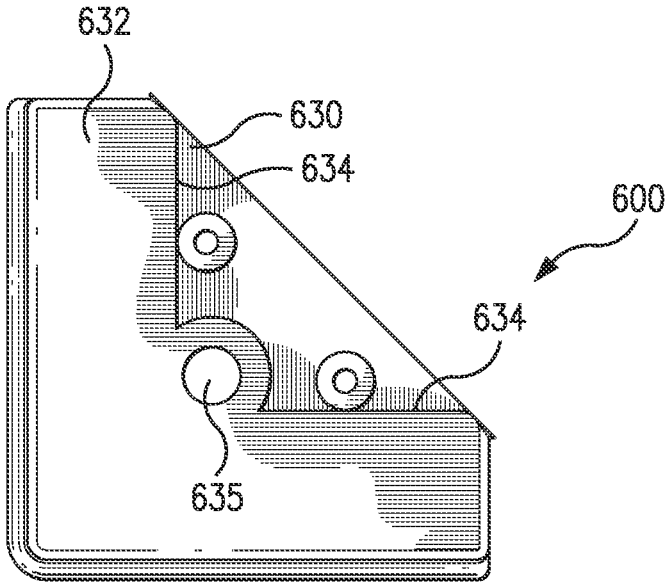
FIG. 20 shows a bottom plan view of the base support post of FIG. 16.
Figure 21:
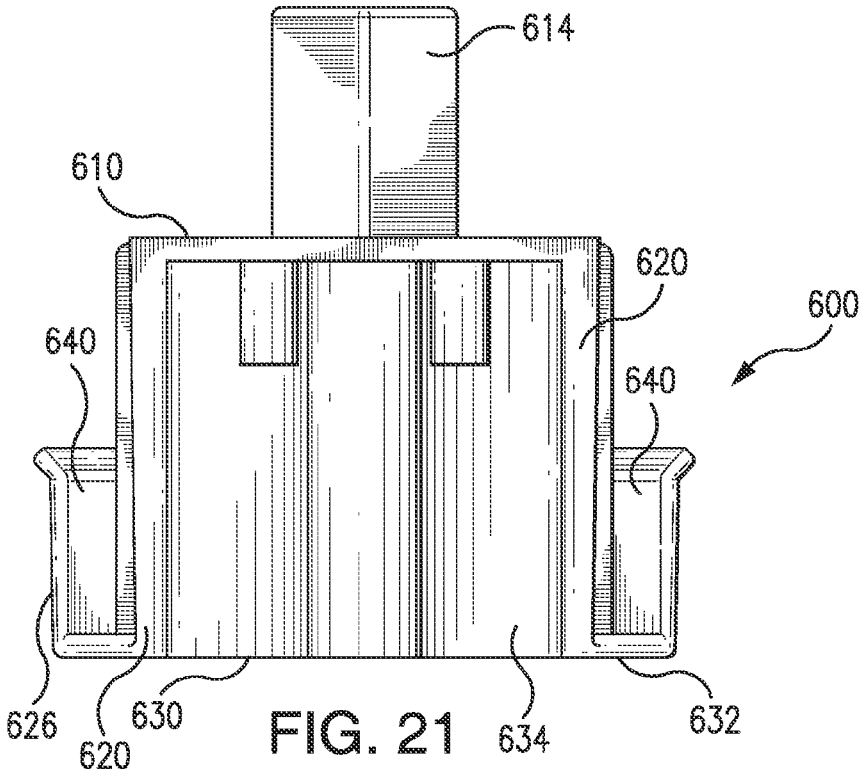
FIG. 21 shows a rear elevation view of the base support post of FIG. 16.
Figure 22:
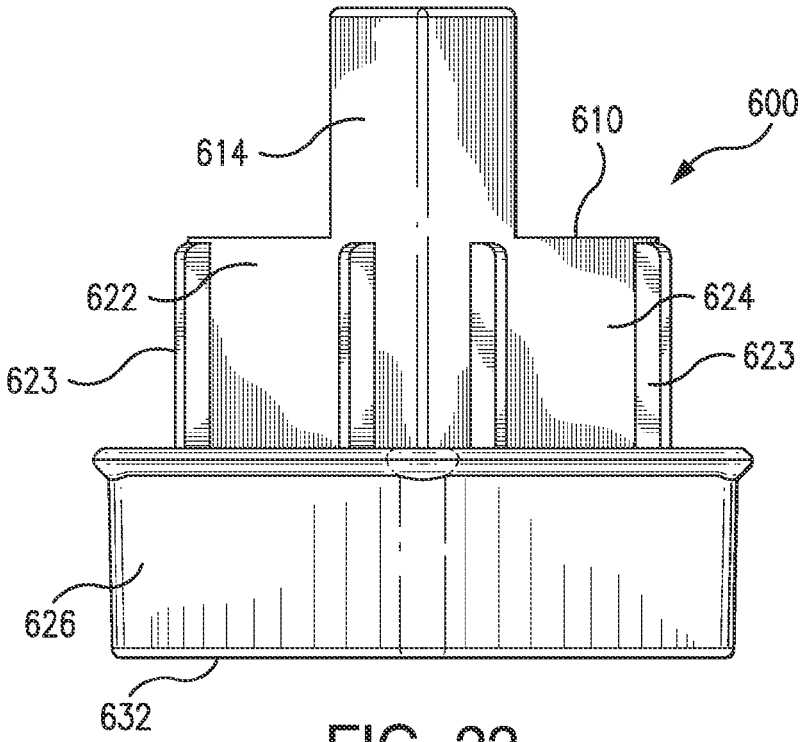
FIG. 22 shows a front elevation view of the base support post of FIG. 16.

In an interlocking post assembly 400, the columnar member 314*a* of the first post 300*a* is slidably received by the cavity (not shown) of the second post 300*b*, the shoulder 312*a* of the first post 300*a* and the seat 332*b* of the second post 300*b* are disposed in abutting engagement, and the skirt 326*b* of the second post 300*b* is disposed in confronting engagement with the body 320*a* of the first post 300*a*. The tapered recess 340*b* of the second post 300*b* expands to receive a portion of the body 320*a* and the shoulder 312*a* of the first post 300*a*. The engagement of the first post 300*a* against the lip 328*b* of the second post 300*b* urges the skirt 326*b* of the second post 300*b* away from the seat 332*b* of the second post 300*b*. The skirt 326*b* of the second post 300*b* is thus disposed in gripping engagement with the first post 300*a*. As shown in FIG. 15, the two posts 300*a*, 300*b* form an assembly and are disposed in an interlocked configuration.

Referring now to FIGS. 16-22, an exemplary embodiment of the base support post 600 is shown. The plurality of base support posts 600 supports the base 500 as well as the plurality of shelves 200 and the plurality of posts 300. Each base support post 600 is coupled with a caster wheel 700 for ease of moving the display fixture 100. For clarity of illustration and to facilitate understanding, the caster wheel 700 has been removed from the base support post 600 shown in FIGS. 16-22.

Each base support post 600 includes a first end 610 and a second end 630 disposed opposite the first end 610. The first end 610 can include a shoulder 612, which can be a substantially planar surface to facilitate engagement of the base support post 600 with the bottom surface 514 of the base 500.

Extending from the shoulder 612 of the first end 610 is a columnar member 614. The columnar member 614 may be rectangular and its cross-section taken along an axis orthogonal to the longitudinal axis of the base support post 600 can be square. Other suitable cross-sections can be used, such as for example, round or triangular. The columnar member 614 is hollow, although it can also be solid in an alternate embodiment. The columnar member 614 of the base support post 600 is configured to be received by the cavity 336 of post 300.

The second end 630 can include a seat 632, which can be a substantially planar surface. The seat 632 can include a seat wall 634, which is disposed substantially orthogonal to the seat 632 and along a perimeter of the seat 632. Disposed on the second end 630 and defined by the seat wall 634 is a cavity 635 configured to receive a stem or post (not shown) of a caster wheel.

Disposed between and joining the shoulder 612 of the first end 610 and the seat 632 of the second end 630 is a body 620. The body 620 includes planar surfaces 622, 624, which are disposed orthogonal to one another. Coupled with and extending from planar surfaces 622, 624 are ribs 623. When the display fixture 100 is assembled, the ribs 623 contact an inner surface of the base panel walls 516 to retain a corner of the base panel walls 516 in conjunction with the other structures of the base support post 600 shown and described herein.

Extending substantially orthogonal to the seat 632 and substantially parallel to planar surfaces 622, 624 is a skirt 626. The skirt 626 surrounds planar surfaces 622, 624 and together with the seat 632 defines a channel or recess 640. The recess 640 of the base support post 600 is configured to receive a corner of the base panel walls 510.

A lip 628 is formed integrally with and extends along an entire periphery of the skirt 626. The lip 628 projects obliquely from the skirt 626 and can act as a guide when receiving the base panel walls 516. Unlike the tapered recess 340 of post 300, the recess 640 of base support post 600 does not expand to receive the base panel walls 516. The base panel 510 is secured to the base support post 600 by a plurality of fasteners 520 that are fixedly attached or engaged with the fastener orifices 650.

While one or more preferred embodiments of the invention have been described above, it should be understood that any and all equivalent realizations of the present invention are included within the scope and spirit thereof. The embodiments depicted are presented by way of example only and not intended as limitations upon the present invention. Thus, it should be understood by those of ordinary skill in this art that the present invention is not limited to these embodiments as modifications can be made. Therefore, it is contemplated that any and all such embodiments are included in the present invention as may fall within the scope and spirit thereof.

That which is claimed:

1. A display fixture comprising:

a plurality of shelves, each shelf comprising a panel for supporting objects thereon, a plurality of apertures formed in the panel and a plurality of walls extending upwardly from the panel and forming a perimeter of the panel; and a plurality of posts supporting the plurality of shelves, each post comprising a generally horizontal shoulder, a columnar member extending upwardly from the shoulder at an upper end of the post, a seat disposed opposite the shoulder at a lower end of the post, the seat comprising a cavity configured to receive a columnar member from another lower post in order to stack one corresponding shelf on top of a second corresponding shelf, an elongate body disposed between and joining the shoulder and the seat, the body including a pair of planar surfaces that intersect each other at an angle and extend from the shoulder to the seat, and a rib extending from the shoulder to the seat and bisecting the pair of planar surface, and a skirt extending from the elongated body and surrounding the seat, the skirt and the seat defining a tapered recess there between, that expands to receive a portion of a corresponding shelf wall.

2. The display fixture of claim 1, wherein the columnar member of a first post extends through one of the panel apertures of a corresponding first shelf and is slidably received by the cavity of a second post.

3. The display fixture of claim 2, wherein the panel of the corresponding first shelf is interposed between the shoulder of the first post and the seat of the second post.

4. The display fixture of claim 3, wherein the skirt of the second post is in gripping engagement with a perimeter surface of corresponding panel walls of the corresponding first shelf which is received by the tapered recess of the second post.

5. The display fixture of claim 4, wherein the perimeter surface of the corresponding panel walls of the corresponding first shelf received by the tapered recess of the second post comprises a corner.

6. The display fixture of claim 1, wherein the skirt of each post comprises a lip projecting obliquely from a base of the skirt.

7. The display fixture of claim 6 further comprising a third post, wherein the columnar member of the second post is slidably received by the cavity of the third post, the shoulder of the second post and the seat of the third post are disposed in abutting engagement, and the skirt of the third post is in confronting engagement with the body of the second post.

8. The display fixture of claim 7, wherein the tapered recess of the third post expands to receive a portion of the body and the shoulder of the second post.

9. The display fixture of claim 1, wherein each panel comprises a top surface and a bottom surface.

10. The display fixture of claim 9, wherein the panel walls of a corresponding shelf are formed from the bottom surface of the corresponding panel.

11. A post for a shelf comprising a panel and corresponding panel walls extending upward from the panel, the post comprising:

a body comprising a first end, a second end opposite the first end and a first planar surface and a second planar surface extending between the first end and the second end of the body, the first planar surface and the second planar intersect each other at an angle, the body of the post defining an open front;

a generally horizontal shoulder disposed on top of the first and second planar surfaces at the first end of the body;

a columnar member extending upwardly from the shoulder;

a seat disposed on the second end of the body, the seat comprising a planar portion that is parallel to the shoulder and a protruding portion extending upwardly from the planar portion, the protruding portion has a first thickness, the protruding portion defines a cavity therein, wherein the cavity extends through the planar portion of the seat, the cavity being sized and configured to receive a corresponding columnar member of a second post;

an elongated rib extending from the shoulder to the seat and extending outwardly from the intersection of the first planar surface and the second planar surface of the body so that the rib bisects the angle formed at the intersection of the first planar surface and the second planar surface, the rib has a second thickness, wherein the first thickness is larger or smaller than the second thickness; and a skirt extending from the body and surrounding the seat, the skirt and the seat defining a tapered recess there between, that expands to receive a portion of a corresponding shelf wall.

12. The post of claim 11, wherein the tapered recess is configured to receive a corner of the shelf.

13. The post of claim 12, wherein the skirt is not parallel to a wall of the seat.

14. The post of claim 12, wherein the skirt is parallel to a wall of the seat when the corner of the shelf is received in the tapered recess.

15. The post of claim 11, wherein the skirt comprises a lip projecting obliquely from a base of the skirt.

16. The post of claim 11, comprising a plurality of ribs extending from the body.

17. An interlocking post assembly comprising:

at least two posts, the at least two posts comprises a first and a second post each of the first and second posts each comprising:

a body comprising a first end, a second end opposite the first end and a first planar surface and a second planar surface extending between the first end and the second end of the body;

a generally horizontal shoulder disposed at the first end of the body;

a columnar member extending upwardly from the shoulder;

a seat disposed opposite the shoulder, the seat comprising a planar portion that is parallel to the shoulder and a protruding portion extending upwardly from the planar portion, the protruding portion defines a first thickness and a cavity therein;

the first planar surface and a second planar surface disposed between and joining the shoulder and the seat, the first planar surface and a second planar surface intersect each other at an angle and extend from the shoulder to the seat, and a rib extending from the shoulder to the seat and bisecting the pair of planar surfaces, the rib defines a second thickness, wherein the first thickness is larger or smaller than the second thickness; and a skirt extending from the body and surrounding the seat, the skirt comprising a lip projecting obliquely from a base of the skirt, the skirt and the seat defining a tapered recess there between, having a closed end and an open end, wherein the tapered recess is wider at the closed end than the open end so that when the columnar member of the first post is slidably received by the cavity of the second post, the shoulder of the first post and the seat of the second post are disposed in abutting engagement, and the skirt of the second post is disposed in gripping engagement with the first post.

18. The interlocking post assembly of claim 17, wherein the tapered recess of the second post expands to receive a portion of the body of the first post.

19. The interlocking post assembly of claim 18, wherein the engagement of the first post against the lip of the second post urges the skirt of the second post away from the seat of the second post.

* * * * *